United States Patent [19]

Barker

[11] 3,998,261

[45] Dec. 21, 1976

[54] CASTING STEEL INGOTS

[75] Inventor: Rodney Barker, Sheffield, England

[73] Assignee: British Steel Corporation, London, England

[22] Filed: June 2, 1975

[21] Appl. No.: 582,789

[30] Foreign Application Priority Data

June 18, 1974 United Kingdom ..... 26971/74

[52] U.S. Cl. ..... 164/66; 164/134

[51] Int. Cl.[2] ..... B22D 7/00; B22D 1/00

[58] Field of Search ..... 164/66, 56, 133, 134

[56] References Cited

UNITED STATES PATENTS

| | | | |
|---|---|---|---|
| 1,583,248 | 5/1926 | Durville | 164/133 |
| 1,814,584 | 7/1931 | Bost et al. | 164/56 |
| 3,392,009 | 7/1968 | Holmes et al. | 164/66 X |
| 3,400,752 | 9/1968 | Unsworth | 164/66 |
| 3,621,903 | 11/1971 | Doi et al. | 164/66 X |
| 3,672,432 | 6/1972 | Widdowson et al. | 164/133 X |
| 3,810,506 | 5/1974 | Kobayashi | 164/133 |
| 3,880,221 | 4/1975 | Bolevski et al. | 164/66 X |

FOREIGN PATENTS OR APPLICATIONS

| | | | |
|---|---|---|---|
| 1,293,987 | 3/1961 | France | 164/66 |
| 38-16609 | 2/1963 | Japan | 164/66 |
| 45-20574 | 3/1967 | Japan | 164/56 |

*Primary Examiner*—Ronald J. Shore
*Attorney, Agent, or Firm*—Bacon & Thomas

[57] ABSTRACT

In the bottom pouring of steel ingots, the molten steel is teemed into a trumpet or upstanding runner and passes from the trumpet through a horizontal runner and up into an ingot mould. Inert gas is injected into the molten steel as it passes downwardly through the trumpet so that bubbles are formed in the steel, which bubbles assist in the removal of non-metallic inclusions. This process is used in the manufacture of steel ingots of very low non-metallic inclusion content and low total oxygen content.

8 Claims, 1 Drawing Figure

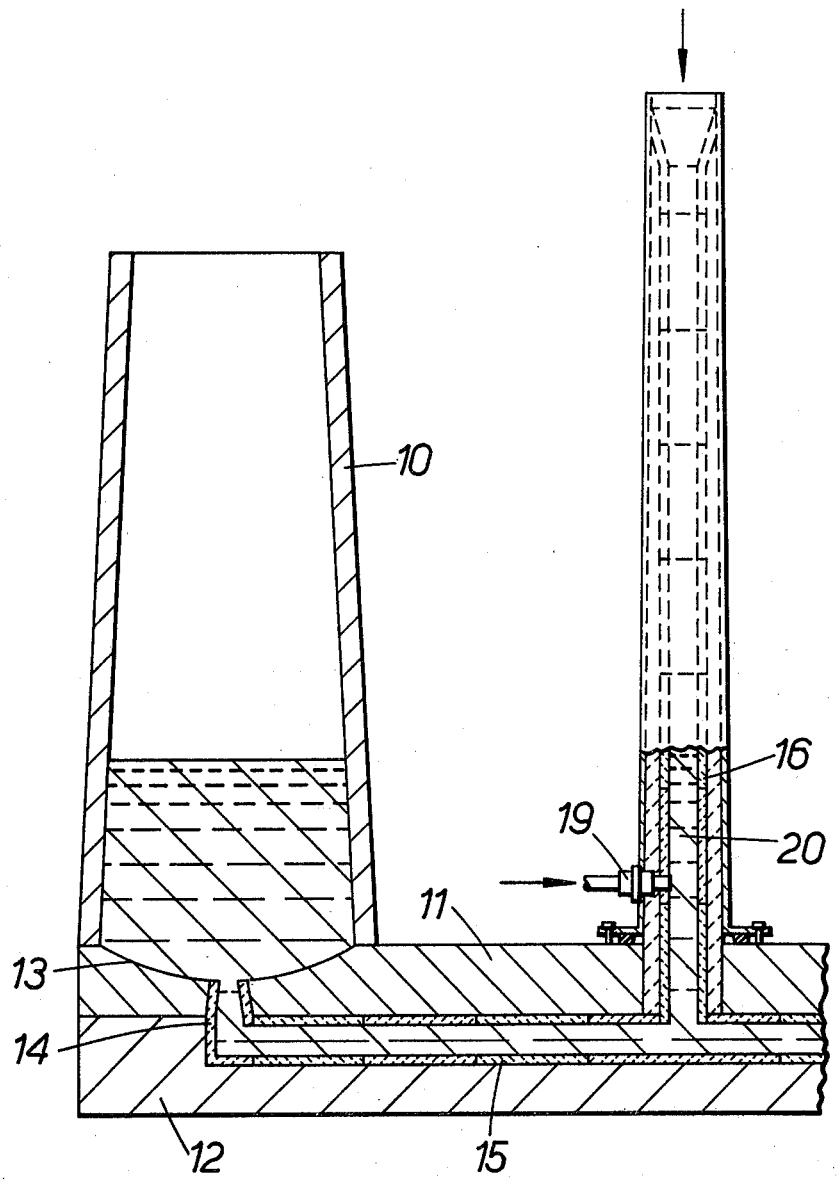
10
16
19
20
11
13
14
12
15

CASTING STEEL INGOTS

This invention relates to the casting of steel ingots. In particular, it relates to the bottom pouring of ingots.

With more stringent requirements from the engineering industry for steel products of increased cleanness (i.e. having less inclusions such as oxy-sulphides, oxides or sulphides), various processes have been developed in recent years. These processes include sophisticated electric arc furnace reducing slag practices, and vacuum or vacuum-electric arc treatments of the molten steel in a ladle or other special vessel. Some of these processes are extremely expensive; others do not perform sufficiently well to give satisfactory ingot cleanness.

It is an object of the invention to provide a method of casting steel ingots which is relatively inexpensive and results in a solidified ingot which has a very low content of non-metallic inclusions, and a reduced total oxygen content as compared with untreated steels.

According to one aspect of the invention a method of casting steel in an ingot mould includes supplying molten steel to the ingot mould through a runner system which exits into the bottom of the mould, said runner system including an upstanding runner into which the steel is poured, and during the pouring of the steel introducing a gas into the molten steel in the upstanding runner.

The gas may be an inert gas such as argon or nitrogen.

The inert gas may be introduced through a single orifice or alternatively it may be introduced through multiple orifices. The orifice is suitably adjacent the bottom of the upstanding runner. The gas may be introduced so that it forms coarse of fine bubbles in the molten steel, a substantial proportion of the bubbles rising up through the molten steel in the upstanding runner.

The gas may be introduced continuously from the commencement of pouring to the end of pouring.

A flux may be added to the molten steel in the upstanding runner during pouring. The flux may include at least one of the following constituents: calcium tetraborate, calcium borate, sodium carbonate, calcium fluoride, and hydroboracite, lime and magnesia.

The introduction of the gas into the steel in the upstanding runner enables inclusions to be entrained in or on the resulting gas bubbles. In the agitation of the steel during teeming these bubbles contact the refractory walls of the upstanding runner and the inclusions adhere to the refractory walls and are thereby removed from the molten steel before it passes into the horizontal runner system. In the upstanding runner there is a relatively large surface area of refractory to which the inclusions can adhere, as compared with a steel-containing ladle equipped with gas-bubbling facilities. When gas bubbles are introduced into the steel just before the steel enters the ingot mould there is very little refractory surface to which the inclusions can adhere. The invention thus provides a significant technical advantage over these two alternate ways of introducing gas into the molten steel.

The accompanying drawing illustrates as an example an elevation in cross-section of one apparatus for carrying out the invention.

An ingot mould 10 of conventional type rests on an upper plate 11 which in turn rests on a base plate 12.

The upper plate 11 is recessed and the recess 13 coincides with the open lower end of the mould 10. A refractory-lined vertical runner 14 extends downwardly from the centre of the recess through the upper plate 11 into the base plate 12, where it connects with a refractory-lined cross runner 15 running horizontally through the base plate 12. The cross-runner 15 is connected with an upstanding trumpet or runner 16 which is also refractory-lined, spaced from the ingot mould 10. The cross-runner 15 may extend to other vertical runners 14 of the type shown in the drawing, so that the upstanding runner 16 may be connected with two or more ingot moulds 10.

A gas conduit 19 is provided through the wall of the upstanding runner, which conduit provides a single orifice for the gas to enter the upstanding runner. The conduit is positioned about 2 inches above the upper surface of upper plate 11, and 8 inches from the junction of the upstanding runner 16 with the cross runner 15.

In use, molten metal 20 is poured from a ladle or tundish (not shown) into the upstanding runner 16 and passes through cross-runner 15 before entering the bottom end of mould 10 via the vertical runner 14 under ferrostatic pressure. The mould 10 is gradually filled with steel in this manner, and pouring then stops. The steel is permitted to cool in mould 10, the steel thereby solidifying to form an ingot.

At the commencement of pouring, an inert gas such as argon or nitrogen is passed under pressure through the gas conduit 19 into the molten steel in the upstanding runner 16. A typical supply of gas feeds 12 liters/-min. of argon at 30 pounds/sq. inch pressure into the molten steel in the upstanding runner 16. Bubbles of gas are thereby formed in the molten steel and rise through the molten steel in upstanding runner 16 to the pouring level. The introduction of the inert gas is continued until the end of pouring.

The size of the gas conduit 19 is of the order of 5mm diameter and the entry of the gas through the conduit produces generally coarse bubbles in the molten steel.

It is believed that the coarse bubbles rising up the molten steel in the upstanding runner 16 result in the physical separation of the deoxidation products and inclusions from the molten steel, such products being then brought to the refractory walls of the runner or to the pouring level in the upstanding runner by means of entrainment and physical attachment to the gas bubbles.

We claim:

1. A method of casting steel in an ingot mould including supplying molten steel to the ingot mould through a runner system which exits into the bottom of the mould, said runner system including an upstanding refractory lined runner into which the steel is poured, and during the pouring of the steel introducing a gas into the molten steel in the upstanding runner such that gas bubbles are formed which entrain inclusions in the molten steel and at least some of which contact said refractory lined runner, the inclusions adhering to said refractory lining and thereby being removed from the molten steel before it passes into the mould.

2. A method as claimed in claim 1 in which the gas is introduced adjacent the bottom of the upstanding runner.

3. A method as claimed in claim 1 in which the gas is an inert gas.

4. A method as claimed in claim 1 in which the gas is introduced continuously from the commencement of pouring to the end of pouring.

5. A method as claimed in claim 1 in which the gas is introduced through a single orifice.

6. A method as claimed in claim 1 in which the gas is introduced to form coarse bubbles in the molten steel.

7. A method as claimed in claim 1 in which a flux is added to the molten steel in the upstanding runner during pouring.

8. A method as claimed in claim 7 in which the flux is selected from the group consisting of: calcium tetraborate, calcium borate, sodium carbonate, calcium fluoride, hydroboracite, lime and magnesia.

* * * * *